United States Patent [19]

Ptaszek

[11] 4,121,389

[45] Oct. 24, 1978

[54] PORTABLE, COLLAPSIBLE STORAGE BINS

[76] Inventor: Waldemar Ptaszek, 297 Park Slope, Clifton, N.J. 07011

[21] Appl. No.: 764,757

[22] Filed: Feb. 2, 1977

[51] Int. Cl.[2] ..... B65G 3/08

[52] U.S. Cl. ..... 52/2; 52/192; 52/224; 214/16 R

[58] Field of Search ..... 52/2–5, 52/224, 192; 214/16 R, 17; 34/233, 201; 135/4 B, 3 R

[56] References Cited

U.S. PATENT DOCUMENTS

| | | | |
|---|---|---|---|
| 1,473,845 | 11/1923 | Gardon | 52/2 X |
| 1,520,569 | 12/1924 | Emerson | 135/4 B |
| 2,730,150 | 1/1956 | Wunderwald et al. | 52/2 X |
| 3,327,874 | 6/1967 | Peterschmidt | 214/16 R |
| 3,453,786 | 7/1969 | Rebarchek | 135/3 R |
| 3,475,915 | 11/1969 | Caplan | 52/2 X |
| 3,539,057 | 11/1970 | Bronner | 52/2 |
| 3,728,831 | 4/1973 | Bird | 52/2 |
| 3,956,816 | 5/1976 | Short | 52/2 |
| 4,015,384 | 4/1977 | Barry | 52/224 |

*Primary Examiner*—J. Karl Bell

*Attorney, Agent, or Firm*—Mel K. Silverman; David A. Jackson; Richard M. Goldberg

[57] ABSTRACT

The present invention discloses a portable, erectile, collapsible storage bin for flowable dry materials, the bin being formed of a flexible, moisture-proof membrane which, when inflated, defines a closed volume having openings for both in-flow and out-flow of material. Said membrane exhibits a conical portion in which said in-flow opening occupies the apex of said cone. There is thus provided a plurality of rigid poles having a height of between two and eight feet, each pole disposed normally to the plane of the ground, each pole equidistantly disposed from each adjacent pole in a circle defined by one radius from the axis of symmetry of said cone. The poles are secured exteriorly to said membrane in order to form thereof an essentially polygonal surface normal to the plane of the ground. There is also provided a plurality of stress-release cables secured to said poles in circumferential relation about the exterior of the membrane in order to provide lateral support against stresses induced by the materials stored in the bin. A plurality of circumferential pockets are formed within the membrane for securing the stress-release cables about the membrane in a fixed relation. Additionally, there is provided a means for erecting said membrane prior to its use wherein said means may comprise either a compressed air input for inflating said membrane in much the nature of a balloon or, alternatively, may comprise a central pole-like support for lifting of the cone portion of the membrane in order to thereby support the entire membrane in a tent-like fashion.

11 Claims, 5 Drawing Figures

PORTABLE, COLLAPSIBLE STORAGE BINS

BACKGROUND OF THE INVENTION

The present invention relates to storage bins and, specifically, to storage bins which are portable, erectile, and collapsible. Such bins are typically used for the storage of hard crops, such as dry grains, beans, peanuts, or the like, where such materials are amenable to free flow.

The need for an invention of the present class derives from a situation in which, during harvesting periods, produce, and in particular grain, is often so rapidly collected that there may not be immediately available, or sufficient, space in commercial elevators, or in other permanently protected storage areas. As a result, quantities or grain may be lost or impaired in value by open piling in the field. Attempts have heretofore been made to improve that situation by locating groups or rigid storage bins near a field or operations. However, it has been found that such rigid bins involve not only a high capital investment but also entail a large overhead cost because of the minor fraction of the year during which they are used. That is, when a harvesting season is completed, there is little use for such bins. Also, it's been found that it is not convenient to bring such bins into the proximity of the harvesting areas.

Accordingly, the present invention includes the provision of a storage bin, composed of a flexible material, which can be easily transported to the harvest area, for example, upon a pickup truck, and, in less than an hour, unloaded and assembled by two men. Following its usage as a storage bin, it can be collapsed and again loaded onto the pickup truck.

The prior art in the present area is represented by such patents as U.S. Pat. No. 1,473,845 (1923) to Gardon, entitled "COLLAPSIBLE GRAINERY;" and U.S. Pat. No. 2,730,150 (1956) to Wunderwald, Entitled "STORAGE BINS."

The above patents disclose the existence of collapsible bins; however, in each case, the portability of such prior art bins has not been fully adequate to meet the needs of agriculture and other related industries. More particularly, prior art bins are not easily moveable, nor are they easily assembled. In many cases the use of guy wires is required.

Also, the prior art does not disclose a collapsible bin having an integral floor, or like material as is hereafter disclosed, which would enhance the out-flow characteristic of the dry material, while protecting the stored material from contamination.

Accordingly, it may be appreciated that a need for an easily transportable and erectible storage bin has long existed in the prior art.

SUMMARY OF THE INVENTION

The present invention comprises a portable, erectile, collapsible storage bin for flowable, dry materials, comprising: (A) an integral, flexible, inflatable, moisture-proof membrane, said membrane, when infalted, defining a closed volume, said volume having openings for the in-flow and out-flow of materials therefrom, and said membrane, when inflated, also exhibiting an upper conical portion in which said in-flow opening is also disposed upon the axis of radial symmetry of said cone, said axis being normal to the plane of the ground upon which the present storage bin is set; (B) a plurality of rigid poles of equal length, each length being between two and eight feet, disposed normal to the plane of the ground, each of said poles being equidistantly disposed from its adjacent pole upon a circle-defined by one radii of said axis of symmetry of said cone, such that an essentially polygonal cross-section defined by the placement of said poles, in which said poles are secured exteriorly to said membrane in order to form thereof an essentially polygonal cylindrical surface normal to the plane of the ground, and thus form a structure having a conical top, a cylindrical middle, and a bottom floor which floor will conform in shape and slope to the shape and slope of whatever rigid surface will be disposed beneath it; (c) a plurality of stress-release cables secured to said rigid poles in circumferential relation about the exterior of said polygonal surface, said stress-release cables serving to provide lateral support to the membrane against stresses induced by the dry flow material as the bin is filled; (d) a plurality of circumferential pockets are formed within the membrane for securing the stress-release cables about the membrane in a fixed relation; and (e) means for erecting said membrane prior to its use, said means comprising a center support disposed upon the axis of symmetry for lifting the membrane in a tent-like fashion, wherein the center support is adapted to support the membrane in a partial volumetric condition until the dry material is displaced therein, whereupon a self-sustaining shallow bin, having a height of between two and eight feet, is thusly obtained.

It is an object of the present invention to provide a low cost, lightweight, portable bin for dry materials.

It is another object to provide a storage bin of the above type having particular adaptability to storage of farm products such as grain, peas, peanuts, and beets.

It is a yet further object to provide a collapsible storage bin which may be easily transported, for example, upon a pickup truck and which may be erected within a time span of about one hour by two men.

Other objects and advantages of the present invention will become apparent from the hereinafter set forth detailed description of the invention.

DETAILED DESCRIPTION OF THE INVENTION

Figure 1:
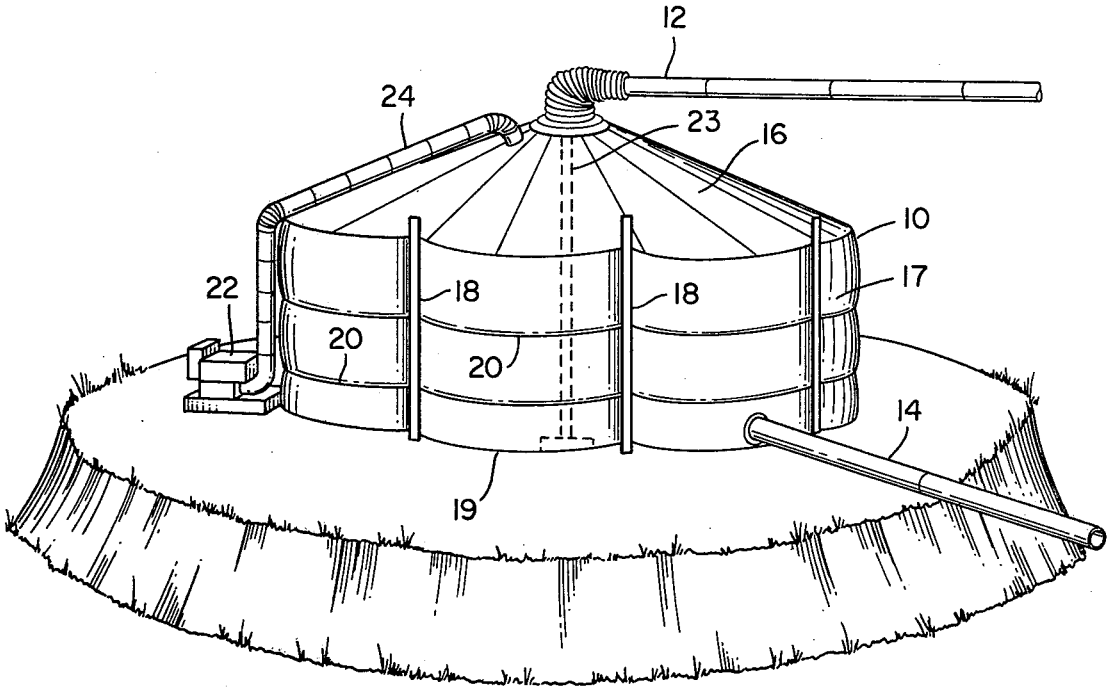
FIG. 1 is a perspective view of the present invention.

The present portable storage bin is formed of a tough, flexible, vinyl-like, moisture-proof membrane which is generally shown in FIG. 1 as element 10. The membrane comprises a closed volume having no opeinings with the exception of an in-flow duct 12, through which loading or conveying of the dry material occurs, and an out-flow channel 14 through which the dry material is carried or conveyed away from the bin.

It is to be noted that the flexible membrane is disposed so as to form a structure having a conical top portion 16, a cylindrical center portion 17 and a base 19 (not shown).

The membrane is initially lifted through the use of either of two erecting means. The first of said means comprises a blower 22 which forces air into the duct 24, thus conveying air into the conical uppoer portion 16. Through the use of such a blower, the membrane is simply filled, in balloon-like fashion, prior to loading. Alternatively, a center post 23 having a flat base and a circular upper portion on, circumferentially disposed about the opening 12 may be used in order to lift the apex of the cone, and thus the entire membrane, in an essentially tent-like fashion.

Figure 2:
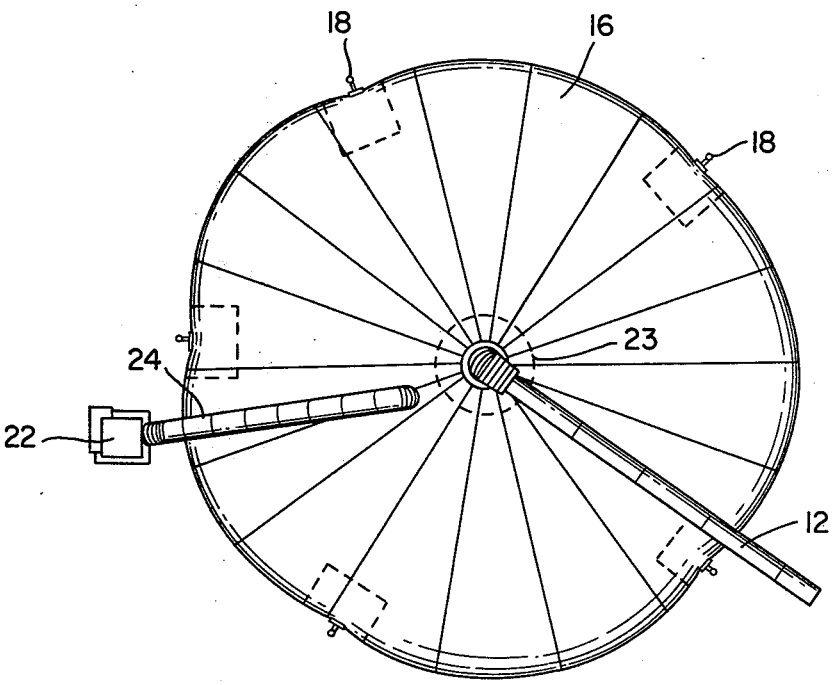
FIG. 2 is a top plan view of the above.

It is to be further noted, in FIGS. 1 and 2, that there is provided a plurality of rigid poles 18, each equal in length, said length being, depending upon the given application, between two and eight feet. The poles are normally disposed to the ground and, in addition, are equidistantly placed from each other in a circle defined by one radii from the axis or symmetry of said cone. Thusly, an essentially polygonal cross-section is defined through the placement of said poles.

Further, said poles are secured exteriorly to said membrane in order to form thereof an essentially polyvinyl cylindrical surface normal to the plane of the ground which, in a given embodiment, may also be the plane of the floor of the membrane. The poles 18 thus provide support for the flexible member 10 against lateral forces, e.g., caused by such things as wind and the weight of grain in the bin. However, it is to be noted that the floor of the membrane is adaptable so as to conform both in slope and in shape to that of whatever surface is placed therebeneath.

In FIG. 1, it is to be further noted that there is provided a plurality of stress-release cables 20 which are circumferentially secured about said rigid poles 18 in exterior relation about the polygonal surface of the membrane. The stress-release cables serve to provide required support to the membrane in order to offset the induced stresses from the dry material within the bin.

Figure 3:
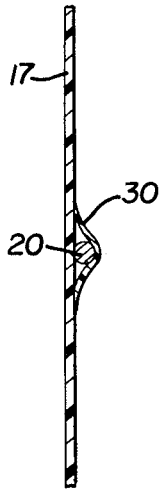
FIG. 3 is a cross-sectional view of a partial segment of the flexible membrane with circumferential pockets formed therein.

It is to be further appreciated that the stress-release cables may be incorporated into a plurality of circumferential compartments or pockets 30 which are preformed into the membrane, as shown in FIG. 3.

Figure 5:
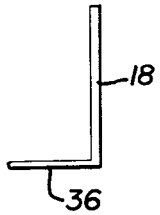
FIG. 5 is a side plan view of a rigid pole of the present invention with a stability plate attached thereto.
Figure 4:
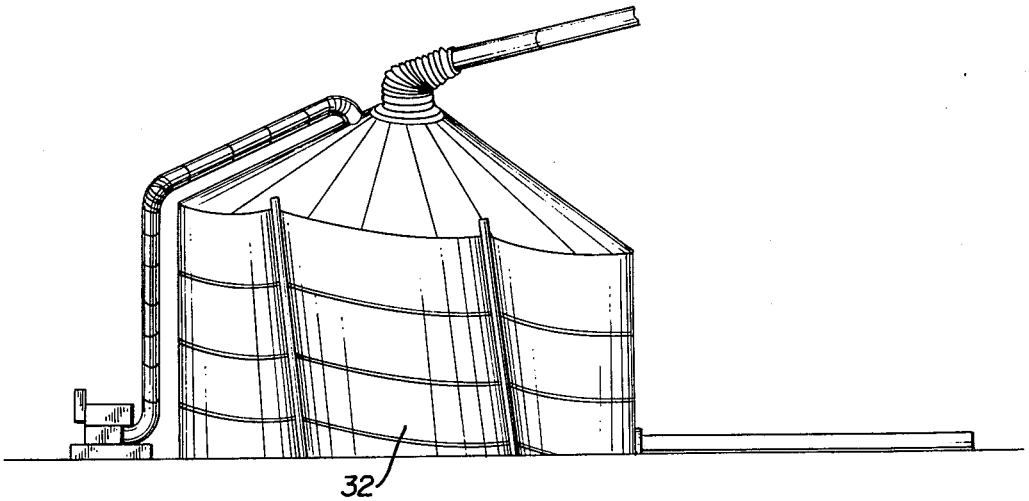
FIG. 4 is a side plan view of the apparatus of the present invention with a rigid surface, having an angle of 1° to 5° with respect to the horizontal, placed therebeneath.

In an additional embodiment of the present invention, a large plate or rigid surface 32, as shown in FIGS. 4 and 5, having a surface with an inclination of between 1° and 5° with respect to the horizontal, may be placed beneath the bottom of the membrane. In addition, rigid poles 18 may be attached to the rigid surface 32. Rigid poles 18 may also include a stability plate 36, as shown in FIG. 6, the stability plate being disposed between the bottom of the flexible membrane and rigid surface 32 so as to be in abuttment with both of these surfaces. Or, alternatively, the ground beneath the floor of the membrane may be sloped with an angle, respective to the horizontal, of between 1° and 5°, which slope will tilt the floor of the membrane in the direction of channel 14, thereby enhancing the flow of material theretowards.

Utilizing the above set forth apparatus and method, portable bins weighing between 100 and 500 pounds may be easily formed.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention what I claim as new, useful and non-obvious and accordingly secure by Letters Patent of the United States is:

1. A portable, erectile, collapsible storage bin for flowable, dry materials comprising:

(a) an integral, flexible, inflatable, moisture-proof membrane, said membrane defining a closed volume, said volume having openings for the in-flow and out-flow of material, and said membrane, when erected also exhibiting a conical portion in which said in-flow opening comprises the apex of said cone and is also disposed upon the axis of radial symmetry thereof;

(b) a plurality of rigid poles for supporting said flexible membrane against lateral forces induced by the dry material therein, each pole being of equal length, each having a height of between two and eight feet, and each disposed normal to the plane of the ground, each pole being equidistantly disposed from each adjacent pole upon a circle defined by one radii of said axis of symmetry of said cone, such that an essentially polygonal cross-section is defined by the placement of said poles, in which said poles are placed exteriorly to said membrane in order to form thereof an essentially polygonal cylindrical surface normal to the plane of the ground, and thus to form a bin structure having a conical top, an essentially cylindrical middle, and a bottom which will conform in both shape and slope to the shape and slope of whatever rigid surface lies, or is placed therebeneath;

(c) a plurality of stress-release cables secured to said rigid poles in circumferential relation about the exterior of said cylindrical surface of said membrane, wherein required lateral support against stresses induced by the dry material, is obtained;

(d) a plurality of circumferential pockets formed within said membrane for securing said stress-release cables about said membrane in a fixed relation; and (e) means for volumetrically erecting said membrane prior to its use, said means comprising a center support disposed upon said axis of symmetry for lifting said membrane in a tent-like fashion, wherein said center support is adapted to support said membrane in a partial volumetric condition until said dry material is displaced therein, whereupon a self-sustaining shallow bin having a height of between two and eight feet is obtained.

2. The storage bin as recited in claim 1 in which said erecting means comprises a means for providing compressed air to said membrane and for maintaining a pressure differential therein until the in-flow of dry material can begin.

3. The storage bin as recited in claim 2 in which said bin further comprises a rigid surface placed beneath the bottom of said membrane, said plane having an angle with respect to the horizontal of between 1° and 5°, said rigid surface acting to tilt the floor of the membrane toward said out-flow opening in order to enhance the rate of material flow theretowards.

4. The bin as recited in claim 1 in which said bin further comprises a rigid surface, placed beneath the bottom of said membrane, said surface having an angle with respect to the horizontal of between 1° and 5°, said rigid surface acting to tilt the floor of the membrane toward said out-flow opening in order to enhance the rate of material flow theretoward.

5. The storage bin as recited in claim 2 in which said membrane comprises a vinyl-type material.

6. The bin as recited in claim 1 in which said membrane comprises a vinyl-like material.

7. The bin as recited in claim 3 in which the bottom ends of each of said plurality of rigid poles are attached to said rigid surface at the periphery thereof.

8. The bin as recited in claim 4 in which the bottom ends of each of said plurality of rigid poles are attached to said rigid surface at the periphery thereof.

9. The bin as recited in claim 1 in which said membrane possesses a total weight of between 100 and 500 pounds.

10. The bin as recited in claim 4 in which each of said plurality of rigid poles is provided with a stability plate for abuttment with the rigid surface beneath the base of the membrane.

11. The bin as recited in claim 1 wherein said center support includes a flat base and a circular top element.

* * * * *